US005743528A

United States Patent [19]

Downey-Jerome

[11] Patent Number: 5,743,528

[45] Date of Patent: Apr. 28, 1998

[54] INTEGRATED BOARD GAME APPARATUS

[76] Inventor: Anne Cecilia Downey-Jerome, 4008 Seven Hills Rd., Castro Valley, Calif. 94546

[21] Appl. No.: 461,689

[22] Filed: Jun. 5, 1995

[51] Int. Cl.[6] ..... A63F 3/00

[52] U.S. Cl. ..... 273/249

[58] Field of Search ..... 273/236, 242, 273/243, 248, 249

[56] References Cited

U.S. PATENT DOCUMENTS

| | | | |
|---|---|---|---|
| 4,966,371 | 10/1990 | Sherman | 273/243 |
| 5,042,816 | 8/1991 | Davis et al. | 273/243 |
| 5,066,015 | 11/1991 | Samrall | 273/243 |
| 5,190,292 | 3/1993 | Perry | 273/243 X |
| 5,224,862 | 7/1993 | Sullivan | 273/243 X |
| 5,273,431 | 12/1993 | Charouhas | 273/243 X |
| 5,332,227 | 7/1994 | Passero | 273/243 |
| 5,360,216 | 11/1994 | Counterman | 273/243 |

*Primary Examiner*—William E. Stoll

[57] ABSTRACT

A Biblical learning system is disclosed. The unit includes a foldable game board with a discretely shaped attachable spinner. The maplike board design has an endless peripheral path contiguous with central path tours. The spinner is positioned on a central area of the game board and has influence points for token direction at specific locations on the path system. A player is represented by a token which moves on all paths; win and loss racers coded to tokens which racers move on independent registers. Dice are included for distance movement of tokens. A number of labeled tour tickets are dealt and allow tokens a choice of path entry after START. Indicia on tour paths are correlated to two decks of activity cards: the first deck bearing Bible verse or movement instructions for tokens; the second deck has penalties for loss racers. The peripheral path has many sequential sectors with random instructions; only one recitation/account station. The method is played by the budgeting of tickets to tours, providing time and space to memorize Bible verse for account station. Only recitation can initiate a win racer. Spinner action directs forward or back token movement from particular points, pacing player progress within a board circuit. A win is determined by first win racer to gain end FINISH position on the win register. A player competes against his own loss register racer as well as other players.

20 Claims, 5 Drawing Sheets

FIG. 1A
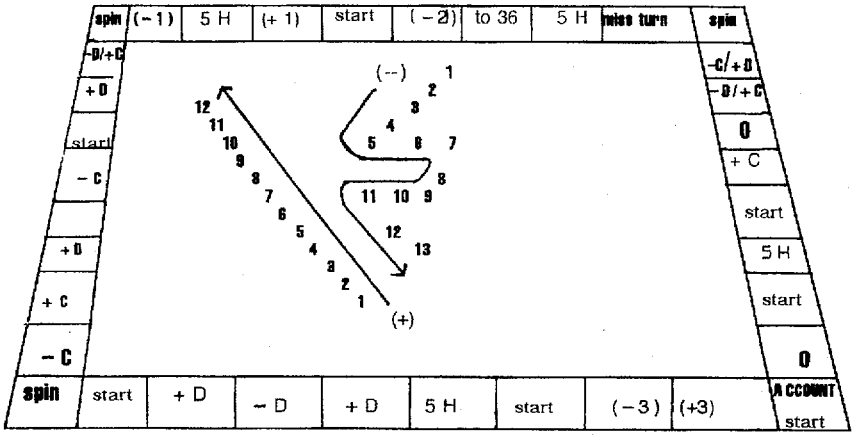
FIG. 1C
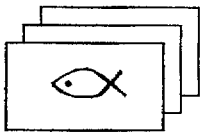
FIG. 1D
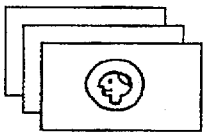
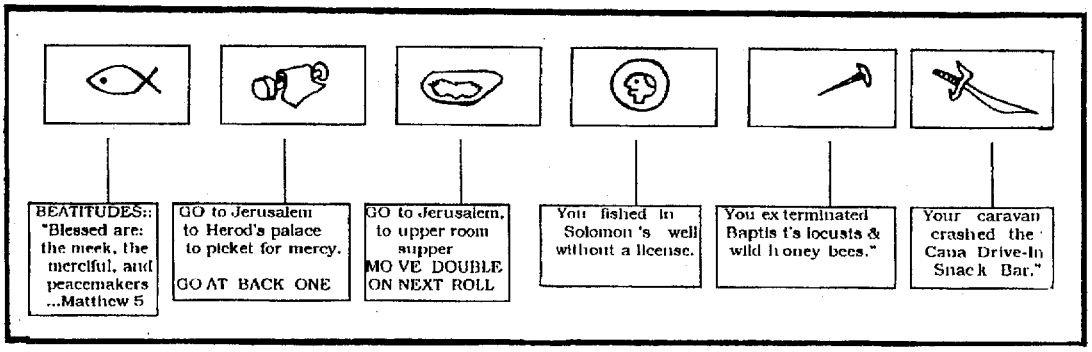
FIG. 1B

FIG. 2
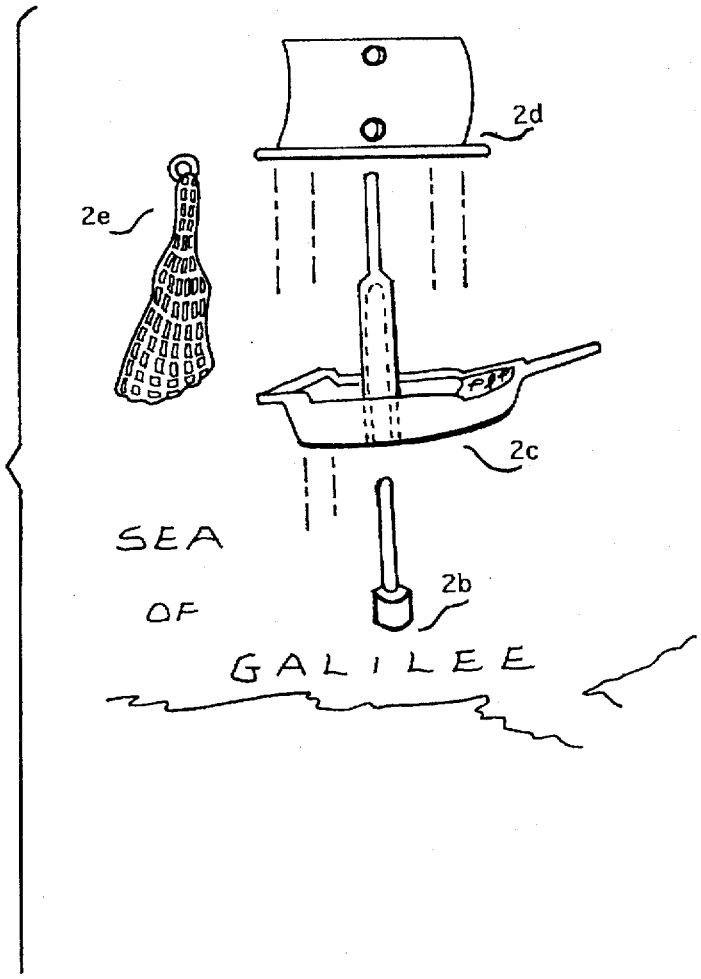
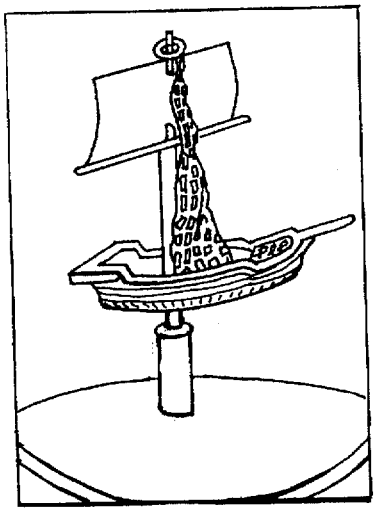
FIG. 2A
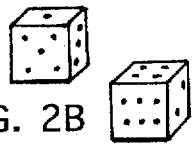
FIG. 2B
FIG. 2C
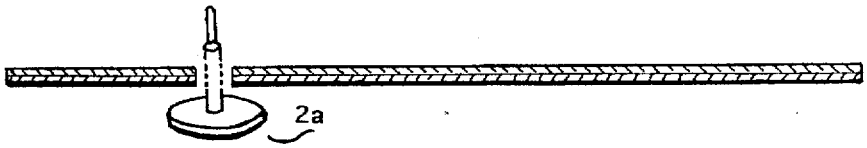

INTEGRATED BOARD GAME APPARATUS

BACKGROUND OF THE INVENTION

1. Field of the Invention

The present invention relates to an ecumenical board game system to reify Biblical knowledge and values by the use of humor and specifically a race using two means of movement, with scripture recitation as the initiator of corollary racers, and the method being strategic planning of primary token travel and timing of voluntary verse performance as moderated by an integrated spinner.

2. Prior Art

Religious education games in general are interpreted or dogmatic, and thus remain static in repeated play, especially with regard to group interaction. Most are question and answer games of various formats:

U.S. Pat. No. 5,071,133 to Smith (1989) sets forth a game in which a random selector permanently changes the player to a "Sunday orientation."

U.S. Pat. No. 5,224,862 to Sullivan (1993) is a game based on St. Paul's symbolic armor of faith; players begin at various points and converge on a vortex.

U.S. Pat. No. 5,152,535 to Roberts (1992) has straight and wide paths; answers to questions from a single Bible translation; freeze cards block an opponent.

U.S. Pat. No. 5,042,816 to Davis et. al. (1990) uses multiple questions with interpreted answers, a point reward system; an answer booklet.

Prior art doesn't provide players with a continuous budgeting process for both positive win resources and negative loss resources, as in a dual race of ancillary tokens which work in a subsidiary fashion to primary token performance. Although some games provide path systems which suggest player orientation in relationship to win strategy alone, and provide learning opportuntiy, negative yield of player activity or inactivity is not treated as a tangible, collectible opposite.

3. Objects and Advantages

Among many advantages of Integrated Board game Apparatus are two decks of cards: FAITH and DOUBT which are the means of the race initiated by primary disciple tokens in their travel about the maplike board environment. Freedom of player path choice teaches moral realities of Biblical times in a lighthearted way by the use of historical puns. A spinner moderates direction of primary tokens. Actual scripture verse is presented and game victory is reliant upon its memorization, while teaching the relationship of talents and free will; the cause and effect association of behavior and soul destination through the use of ancillary token racers coded to the primary disciple tokens.

Thus, it may be appreciated that there continues to be a need for a Biblical education game which sets forth an accounting system for individual talent resources in an historically real and physically tangible way, while addressing a need for an inter active tool of Christian education which is portable, lightweight, easy to set up, and a versatile tool for home or classroom.

SUMMARY OF THE INVENTION

This invention is provided to satisfy the foregoing needs in availing scriptural knowledge in a challenging and entertaining format. A board game is presented which includes a learning system for two to four players of moderate Bible knowledge. It has geographic and historical references on its surface, in and around a number of paths contiguous with a peripheral path. A prominent feature of integrated board game system is a discretely shaped direction selection spinner which moderates the choices of players as an outside force would act in direction selection and learning. Each successive playing of the game expands knowledge of scripture and permits personal growth and faith experience by use of a compelling and entertaining system of pathways.

Player figurines are moveable on all of these paths with two dice according to a number of ticket choices provided to contrast modern opportunity to the timeless setting of the four major cities of Christ's life. Game involvement levels are individual, with player responding to random bonus and penalty induced events, but primarily in response to the players own planning and use of resources, both dealt and earned. Change of player orientation by direction spinner paces players and prompts them to budget performance opportunities, namely scripture memorization and recitation.

A behavioral accounting system for primary tokens is simulated by a pair of correlated racer tokens, each player being represented thusly by a set of three game pieces. The primary token moves on geographic paths representing life experiences and two correlated racers which are a function of player choices or indecision are placed only on two independent behavior registers with win/loss destination when and if such game choices warrant. Game ratios are skewed to insure that players end with competition of win register racers; loss register racers function either as a debit deduction requirement for winner and those placing in race on win register, or as remainders which are left standing on in their loss register tracks.

Degree of involvement of path token game piece reflects free choice of ticket use to tour paths with a high ratio of faith opportunity or direct experience with Bible verse learning and its witnessing at the single performance station on the peripheral path. Activity of token then, is a function of path choices which reflect a ratio of opportunity, with outer peripheral path having a lesser ratio of both positive and negative choices for reward progress; central path tours having a higher ratio of opportunity for activity and consequent positive and negative results.

It is important to note that all players must end their moves from tours onto peripheral path. Tickets to central path tours must be used within a board circuit in order to be replenished, and the ticket allowance is balanced at the single corner Account square which serves as recitation performance square at which players give scriptural accounts. The three corners opposite the Account square are subject to the forward/backward requirement of the direction selection spinner which uses only one die from its locus points, containing the action within a board circuit.

This invention exists not in any one of these structures, features or methods per se, but in the particular combination or system of all the units herein disclosed and claimed and it is distinguished from the prior art in this particular combination of parts for the functions specified.

Another object of the present invention is to provide the player with a trinitarian game comprising three levels of learning by handling themed talent tickets inferring inherent opportunity; moving both at random and with premeditated planning; committing to memory actual, uninterpreted scripture which agrees with all Bible versions.

Still another object the present invention is to provide a relaxed view of history and religion, wherein players of different denominations can associate with modern problems and solutions a recognizably classic behavior and its consequences, while retaining respect for the real nature of reward and punishment.

BRIEF DESCRIPTION OF THE DRAWINGS

FIG. 1A is a perspective view of the game board displaying peripheral path numerical values corresponding to inner board: win (+) register track/loss (–) register track, and peripheral path letter values corresponding to tickets and card decks.

FIG. 1B is a perspective view of FAITH and DOUBT game cards showing both top view and card faces.

FIG. 2A is a direction selection spinner, fully assembled.

FIG. 2 is an exploded view comprising:

2*a* Spinner Platform; 2*b* Mast Pin; 2*c* Hull; 2*d* Sail; 2*e* Net.

FIG. 2B is a perspective view of dice.

FIG. 2C is a dimensional view of game board with maplike area having reciprocal slots for spinner platform foot (flange) insertions.

Figure 3:
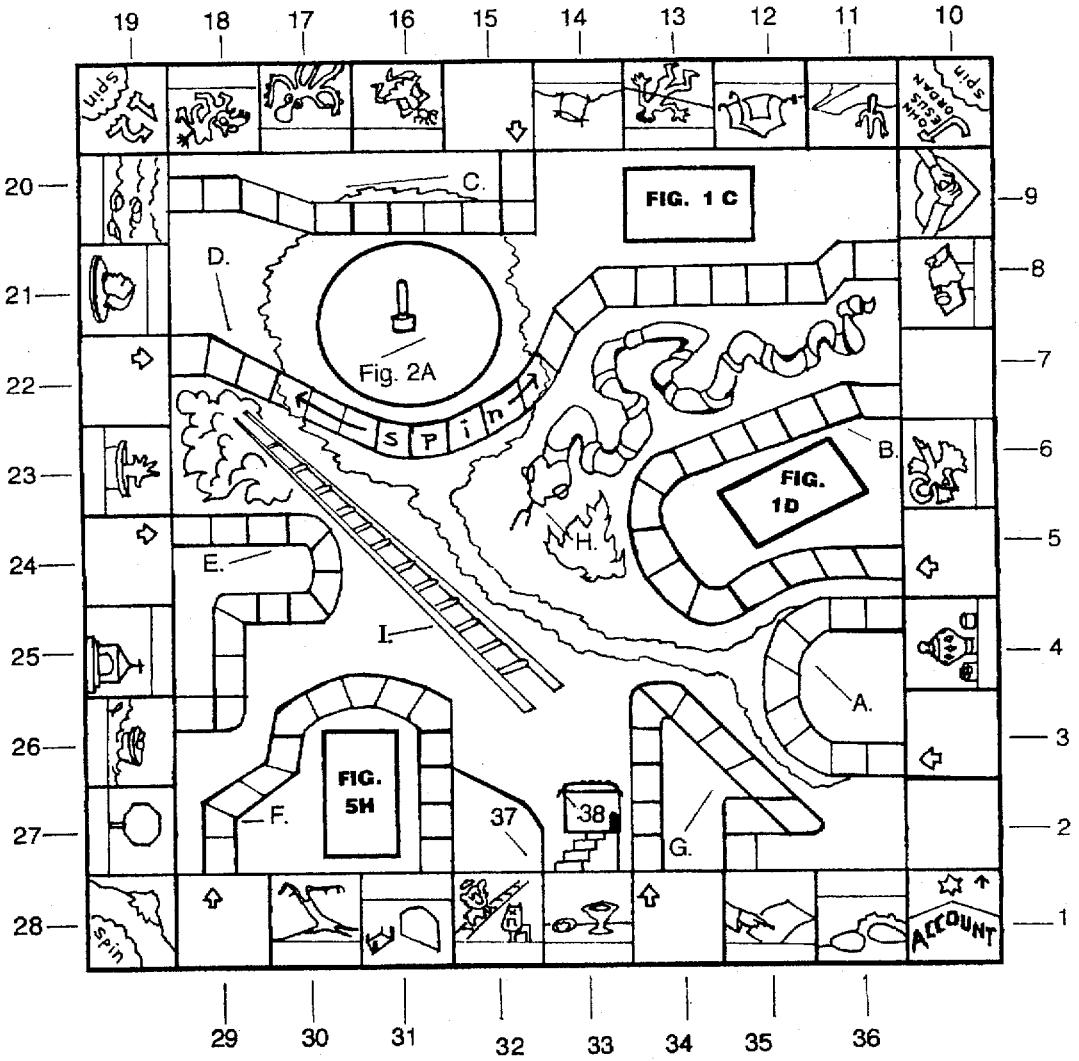

FIG. 3 is a detailed plan view of the board readied for spinner (2A) tickets (5H) and card decks (1C) and (1D) placement.

Figure 4:
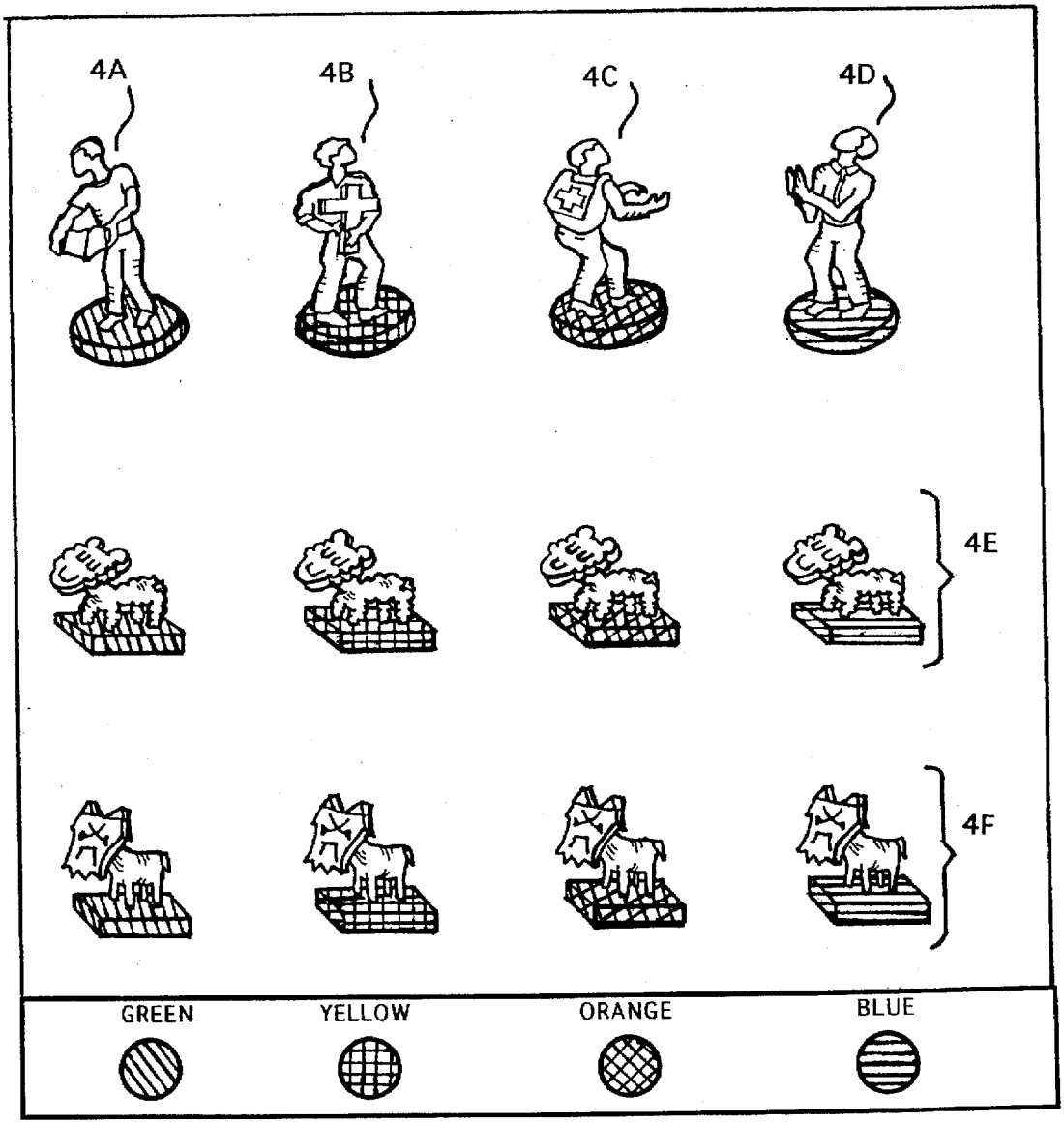

FIG. 4 is a perspective view of the three piece playing sets, including disciple tokens: 4A—student "Matthew"; 4B missionary "Mark"; 4C medic "Luke"; 4D evangelist "John"; 4E win register racer (sheep); 4F loss register racer (goat).

Figure 5:
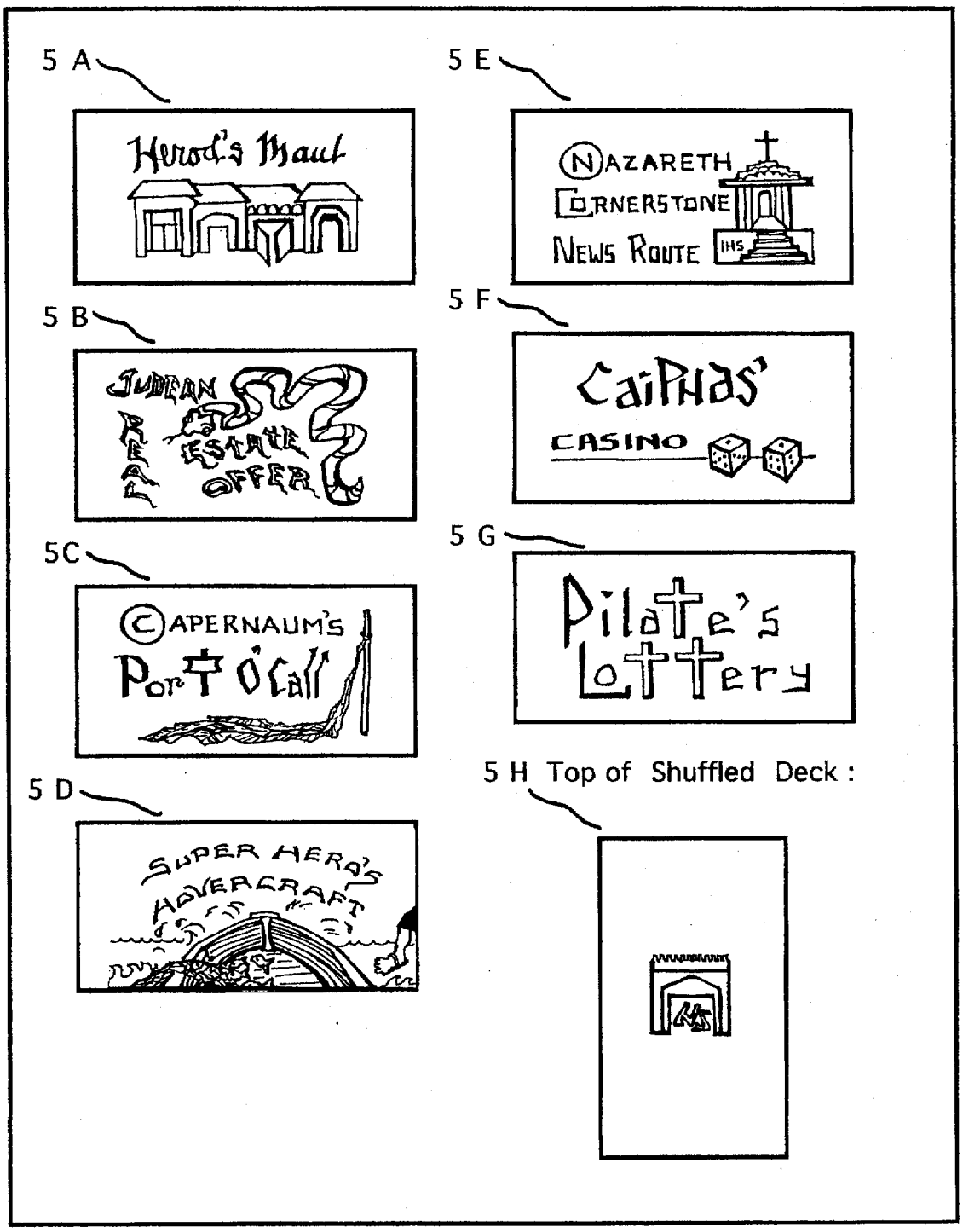

FIG. 5 is a top view of a the complete deck of tour tickets comprising tour tickets (5A–5H) matching board paths shown on FIG. 3: (3A–3G): FIG. 5A "Herod's Maul" 5B "Judean Real Estate Offer" 5C "Capernaum's Port O'Call" 5D "Superhero's Hovercraft" 5E "Nazareth Cornerstone News Route" 5F "Caiphas' Casino" 5G "Pilate's Lottery".

DETAILED DESCRIPTION OF THE INVENTION

With reference now to the drawings, and in particular FIGS. 1–3 thereof, an integrated board game learning system embodying the principles and concepts generally designated by the reference numeral 1A will be described.

More specifically, and referring particularly to FIGS. 2–3, integrated scriptural board game includes a planar game board 2C which may be constructed of a rigid material such as cardboard; assembled direction selection spinner 2A is constructed of hard dense material such as plastic, and when assembled, attached to game board to form an integrated educational unit. The advantages of the discretely shaped spinner 2A, in addition to its symbolic value in a historic context, are its physical properties superior to conventional flimsy metal pointers which wobble when spun. Integrated direction selection spinner has a vertical mast member-stabilizing base 2*c*, which works with horizontal boom-sail unit 2*d* in a perpendicular fashion, which substantially square sail 2*d* balances and weights rotation for smooth performance.

The length of base 2*c*, exclusive of its pointer extension, is equal to the height of its vertical mast member. The diameter of platform 2*a* is twice the length of spinner base 2*c*. This proportional relationship provides spinner stability of operation for manual rotation. Further stability is provided by the design of the base-hull 2*c* which has an anterior hull design that is tapered. Centrifical force and consequent lift is compensated by a triangular weight at juncture of pointer which weight counter balances the wider posterior stern lip of hull-base 2*c*. Also of note is the net-clamp 2*e* which firmly attaches sail member, which model configuration 2*d*, 2*e* may be permanently attached by manufacturer. Platform 2*a* covers lithographed game board illustration, protecting laminated paper surface from effects of wear from spinner rotation.

Imprinted on one planar surface of board 2C are maplike geographic features and a substantially square and endless peripheral playing path 1–36, with substantially square sectors imprinted with cartoons relating to Christ's life, and which path is contiguous with seven central tour paths of varying length and configuration 3A–3G, two specialty stations 37 and 38 adjacent to peripheral path and near corner Account-START square 1.

Turning now to FIG. 3 in conjunction with FIG. 4: An independent loss register of thirteen radically curved segments H, to accomodate loss racer token 4F, is located between tour paths near the center of the board. An independent win register I, of twelve substantially square contiguous segments to accomodate win racer token 4E, is located between path tours near the center of the board. FIG. 1A tracks the twelve rungs of the win register I, with its (+) win value and keyed to squares on the peripheral path which award random step values, for example +1 or +3—these correspond to step moves for win racers 4E, on win register (+) I. And opposingly: negative valued numbers depicted around the board peripheral path require penalty steps (e.g. –3 or –2) on the loss register (–) for loss racers 4F on H. The value of the outer path differs from inner tours in that on the peripheral path, every direct win racer bonus (+) has at least equivalent loss racer penalty (–). FIG. 1A shows one side of board with (–3), (+3) adjacent sectors; opposite side of board (–1), (+1), (–2), for a net negative racer peripheral path value of (–2).

With regard to activity cards, in FIG. 1B, 1C Faith cards work to act upon the primary disciple tokens 4A–4D movement to facilitate player position advantage or performance opportunity in relation to Account-START square 1: (e.g.) FAITH card 1C with top indicia a "fish" has its content directions to proceed to "Herod's Palace" 37; another card has directions to the "upper room" 38, these stations have close proximity to Account-START square 1 which is the hub of opportunity for players when disciple tokens 4A–4D pass this beginning corner, as a source for tour tickets 5A–5G, as well as the stage for giving vocal account to scripture memorized from FAITH cards 1C, as shown in FIG. 1B. Also shown on peripheral path of board FIG. 1A is the balanced number of bonus and penalty opportunities with regard to FAITH CARDS: FIG. 1C (+C) (–C)(+C), with a net board gain of one FAITH card (+C); and accordingly, around the board, DOUBT cards FIG. 1D: with a net gain of two DOUBT cards (–D), (–D). Therefore, the outer board has a negative value yield, with an activity potential for negative racer 4F of (–2) which is a direct loss value on loss register H. A more indirect negative value are DOUBT cards FIG. 1D, which must be used subsequently, in like indicia multiples, for a rung on loss track H, but still contribute to the overall negative value of the outer board.

Also considering FIG. 1A and the inner Tours which award FAITH cards FIG. 1C and DOUBT cards FIG. 1D. These two decks of game activity cards work indirectly upon the win racer FIG. 4E and loss racer FIG. 4F because they require performance before they activate the racers. Incidence of these cards' indicia as shown in FIG. 1B on inner board tours is dependent upon the length of the tour paths as shown on FIG. 3A–3G. The tour paths contain indicia card draw opportuntiy in the following ratio:

TOUR PATH INDICIA FREQUENCY

| | FAITH CARD (+1) | DOUBT CARD (−1/3) |
|---|---|---|
| (3A) TOUR ONE | 4 | 3 |
| (3B) TOUR TWO | 4 | 4 |
| (3C) TOUR THREE | 3 | 2 |
| (3D) TOUR FOUR | 8 | 2 |
| (3E) TOUR FIVE | 4 | 4 |
| (3F) TOUR SIX | 5 | 3 |
| (3G) TOUR SEVEN | 3 | 4 |
| TOTAL | 31 | 22 |

Thus it may be noted that the overall central path tours comprise a much higher ratio of positive value than peripheral path—FAITH cards 1C with each +1 value representing a possible step for a win racer 4E racer on win register I, with the ⅓ value for DOUBT cards 1D indicating that they must always be used in groups of 3 to mandate a penalty of loss racer 4F one step on the loss register H.

Referring now to FIG. 2, Two Random Selectors: FIG. 2A is a direction selector spinner (forward/back) which works in conjunction with one of FIG. 2B a single die, as shown in FIG. 3 requiring "SPIN" from corner squares 10, 19, 28 and an eight sequential sector of tour 3D requiring "SPIN" and one die limitation. This action slows disciple token movement on peripheral path 1–36 from three corners, limiting tour path travel. The "SPIN" action within tour 3D, opportunity for FAITH card indicia is greatly increased, when the one die move yield is considered with specialty section length and the FAITH card indicia present on tour 3D, as can be seen from the table above, in tandem with the forward/back action of the direction spinner 2A.

A means of game advancement is the gathering of three indicia types of FAITH cards 1C because they work to earn win racer 4E steps on win register I in three ways:

1) By memorization and successful recitation of Bible verse found thereon, thus earning a win racer step (unsuccessful attempt allows card retention for retry) The only way to win is to attain the win track top; the only way to initiate a win racer onto the track is by successful recitation.

2) "Bonus" cards included in a single indicia type can be used for a bonus racer racer step, but only with recitation.

3) Turned over and matched by indicia type, the same FAITH card can be used for a second time, for another racer step, before returning card to the deck.

The general method of playing the game is as follows:

The game may be played by two to four players, each of whom selects a three-piece color keyed token set comprising one disciple figurine 4A, 4B, 4C, or 4D and its matching pair of: win racer 4E and loss racer 4F. Each player places his/her disciple figurine on the ACCOUNT/START square 1, retaining his pair of racers: 4E, 4F in front of him.

One of the players shuffles the stack of tour tickets 5H; another sorts the stacks of FAITH cards 1C by indicia: (e.g. "fish" at top/"bread" at center/"scrolls" at bottom); DOUBT cards 1D are likewise sorted by indicia (e.g. "coins" at top/"nails" at center/"swords" at bottom). The players to do this are arbitrary, as after start of game, each person draws his own replacement tickets or cards as the board directs.

Three tour tickets 5A–5G are chosen or dealt face up from the shuffled stack 5H, to each player. Two dice 2B are rolled to see which player figurine moves first. All players begin at the ACCOUNT/START square initially, and always move in a counterclock-wise direction thereafter, returning to 1 to complete a circuit. After the initial turn, each player in the course of the play, decides when he/she wants to remain on peripheral path 1–36, or use one of his three tour tickets 5A–5G to go directly to one of the tour entry sectors: 3, 5, 15, 22, 24, 29, or 36. After spending the ticket, he must return it to the bottom of the ticket stack 5H. Players' tour tickets are only replenished upon a circuit of the board, at the ACCOUNT/START square 1 if he/she has spent some and has less than three.

Two dice are rolled by the selected beginner, and he moves the equivalent number of spaces. If (both) players choose to travel peripheral path, they may accrue additional tour tickets 5H, as squares 4, 12, 17 and 23 award one extra ticket which must be either spent on a tour or relinquished, (if it adds to the allowed tally of three), at the ACCOUNT/SQUARE 1. (Tickets returned are player's choice). Player may proceed to any tour of his choice, regardless of proximity, as long as he continues in a counter-clockwise direction. If he lands on a "SPIN" corner 10, 19, or 28, he must use only one of die 2B, and spin for a possible 50% chance of backward movement. This allows him to reconsider ticket use, as he's in a clockwise mode, and may have just received a new tour ticket from 5H award squares 4, 12, 17 or 23.

Within a tour path, player uses both dice 2B, and indicia on path sectors match pre-sorted FAITH cards 1C and DOUBT cards 1D, which he must draw upon landing on their path sectors. If he draws a FAITH card 1C with a Bible verse printed on its face, he places it face up in front of him, so that he may memorize it as he waits for others to play. If it is a DOUBT card 1D, he reads the historical pun, but need not memorize it; places it face down in front of him, with its indicia up, so that when he accumulates three cards of like indicia, he must place his loss racer 4F on loss register H.

Players move disciple tokens around the board, budgeting tickets to tours with the time and space remaining, and memorizing FAITH card 1C verse before a circuit is completed. At the ACCOUNT/START square 1, he can recite, if ready. A successful recitation allows player to place his win racer 4E on win register I. After recitation, player turns FAITH card 1C over to reveal indicia for matching to two others (total 3) of like kind for an extra step for win racer 4E on win register I. Included in the deck of FAITH cards 1C are five bonus cards which can be used only with recitation for another extra step for win racer 4E on win register I. Thus a player is racing his own win racer 4E against his own loss racer 4F, as well as competing with his opponents.

If a player rolls double sixes with dice 2B, he is awarded an extra step for racer 4E on win track I, but only if win racer is already on board. The only way that a win racer may be placed on the board is by successful recitation of Bible verse. If a player rolls double ones with dice 2B, he must place his loss racer 4F on loss track H, or if racer is already on the track, move it down one space toward an end loss position.

With regard to FIG. 3, on peripheral path, sector 13 allows player to "jump" to sector 36. Two specialty stations 37 and 38 are administered by a number of FAITH deck 1C cards, and give random card draw advantage to a player through instant progress to these locations near the ACCOUNT/START square 1. Player must adjust his memorization timing to accomodate these involuntary influences as well as a number of peripheral path bonus squares 6, 8, 13, 16, 26, 31, 36 and penalty squares 9, 11, 14, 18, 20, 21, 23, 25, 27, 30, 32, and 35.

Direction spinner 2A must be spun and only one of dice 2B used when player lands on corner squares 10, 19 and 28, and when on eight of the central steps of tour path 3D. Reverse play requirement on player's next turn can be used to study verse for recitation, or to outguess an opponent by using a different tour ticket, since all tour tickets, 5A–5G are always left in front of players in a face-up mode. Competition is learning of actual, uninterpreted Bible verse.

On tour path 3D, with only one die and its move yield of six steps, the specialty area being eight sectors and a SPIN required whenever a player remains in spinner 2A jurisdiction, a player's disciple token may remain in a forward/back mode "fishing" for FAITH cards 1C for several turns.

Each tour has a varying degree of card activity opportuntiy, but FIG. 1A shows that the central board tours have an overall win value higher than the connecting peripheral path. Thus players budget talent tour ticket resources to contain DOUBT card 1D risk before loss racer 4F prevails, while using FAITH cards 1C to propel win racer 4E to the end win position on win register I before other racers.

I claim:

1. A Scriptural learning system representing sin and salvation in a lighthearted and contemporary context, the object of the game being to budget player movement and memorization of Bible verses with the random pacing of a direction selection spinner, and comprising in combination:

a rectangular game board having equilateral sides, a planar surface printed with maplike pictorial graphics, whererein a central geographic area thereof contains an insertion hole which is centered in said geographic area in the center of a circle;

a direction selection spinner with a circular platform having a central spindle which is secured beneath said board and tightened through said hole, wherein said top graphics on the board contain a circle encompassing said hole with a diameter line printed on the middle thereof dividing said semicircle into two semicircular portions: FORWARD and BACK, and the upper portion of said spinner is fashioned to resemble a boat with a prow and a pointer which boatlike upper portion is manually rotatable, compassing the platform;

an endless peripheral path of substantially square consecutive sectors having written instructions thereon and which peripheral path is square and having four corners thereon and said peripheral path being contiguous with central path tours, which tours extend away from the peripheral path and return thereto, said tours having various indicia thereon;

a plurality of peripheral path corner sectors with instructions to spin said direction selection spinner;

at least one central path tour beginning and ending on the peripheral path, and interrupted by a special sequential tour path portion keyed to the spinner;

a plurality of distinguishable moveable disciple game piece sets consisting of a primary playing token fashioned to resemble a disciple in modern garb, said primary token capable of movement on said peripheral paths and contiguous central tour paths, a win token racer fashioned to resemble a sheep said win token capable of movement on a win register, a loss token racer fashioned to resemble a goat said loss token capable of movement on a loss register, said game piece bases being color coded to each other, and which sets represent individual players;

a means for randomly selecting a number corresponding to distance movement of a token along the peripheral path and central path tours;

a plurality of tickets for admission to the central path tours, said tickets printed with identifying tour logos which correspond to tour logos printed on the game board;

a deck of FAITH activity cards printed on one side with Bible verse or bonus instructions, and on the reverse side with one of a plurality of types of FAITH card indicia corresponding to indicia on tour paths;

a deck of DOUBT cards printed on one side with historical puns and on the reverse side with a plurality of DOUBT card indicia correlated to indicia on tour paths;

a win register, independent of the paths, upon which a player's win racer is placed and moved toward an end win position;

a loss register, independent of the paths, upon which loss racers are placed and moved toward an end loss position;

an ACCOUNT/START station located at a peripheral path corner position; and at least one specialty station, near the ACCOUNT/START station, said specialty station accessed by specific FAITH cards.

2. The integrated learning system of claim 1 wherein the means for selecting a number corresponding to distance movement of a player along the peripheral and central paths is two dice; wherein path SPIN instruction stations limit distance movement by use of only one die for turn or turns while in jurisdiction of said station or path portion coded to the direction selection spinner.

3. The integrated learning system of claim 2 wherein the disciple token circuit of the board is paced by use of the direction selection spinner which slows progress by means of its pointer portions of 50% forward/50% backward and one die distance allowance from the three corners and in the specialty tour path portion.

4. The integrated learning system of claim 3 wherein the specialty tour path portion governed by the direction selection spinner and one die has more path sectors than the six-sector move yield of one die, and a token that remains earns FAITH cards from path indicia for more than one turn in a forward/back mode.

5. The integrated learning system of claim 3 wherein the spinner reverse requirement may back a token out of a central tour path specialty section and onto the peripheral path, thus relinquishing an advantage to an opponent as said tour ticket is spent.

6. The integrated learning system of claim 3 wherein the direction selection spinner exerts control from three corners opposite the ACCOUNT station corner square and has a forward/back yield for two to four players, moderating overall player movement within a board circuit.

7. The integrated learning system of claim 2 wherein path travel distance is increased by use of tickets to the central path tours which shuffled ticket allowance is dealt at the beginning of the game and replenished at a completed board circuit.

8. The integrated learning system of claim 7 wherein central tour paths contain FAITH and DOUBT card indicia opportunity in a greater win ratio than peripheral path sectors' random bonus and penalty consequences.

9. The integrated learning system of claim 8 wherein central path tours contain DOUBT indicia for DOUBT card gathering, which cards in specific multiples require initiation or movement of loss racers on the loss register.

10. The integrated learning system of claim 9 wherein tickets to the central path tours are retained and the peripheral path used while memorizing a Bible verse to perform.

11. The integrated learning system of claim 9 wherein particular ticket usage to tour paths with a high ratio of reward indicia reduces risk of loss racer activation, thus a player competes against himself by voluntarily pacing of the token and consequent win and loss racer activity.

12. The integrated learning system of claim 8 wherein FAITH activity cards garnered on central path tours are printed with a Bible verse to be recited with all players as witnesses and which recitation activates the win racer on the win register.

13. The integrated learning system of claim 12 wherein FAITH cards with Bible verse remain face up in front of a player until recitation.

14. The integrated learning system of claim 13 wherein FAITH cards are printed with a Bible verse on said cards' faces; after recitation performance the cards are turned over and matched by indicia in specific multiples as a means of credit for additional steps for the win racer on the win register.

15. The integrated learning system of claim 14 wherein a Bible verse recitation is only performed at the recitation station after the disciple token has completed a circuit of the board.

16. The integrated learning system of claim 15 wherein disciple token circuit of the board is accelerated by use of a specific tour ticket to bypass portions of the peripheral path, thereby hastening the board circuit to the ACCOUNT station and recitation.

17. The integrated learning system of claim 16 wherein a plurality of peripheral path bonus sectors award one tour ticket.

18. The integrated learning system of claim 17 wherein the ACCOUNT station is a source for reconciling tour ticket allowance per board circuit: either relinquishment of tickets above initial allowance, or replenishment to original quantity.

19. The integrated learning system of claim 18 wherein tickets to the central path tours used with Bible verse FAITH cards garnered therein pace primary token movement past the corner ACCOUNT/START station, said use being a means of movement to propel the win racer on the win register.

20. The integrated learning system of claim 19 wherein a plurality of particular FAITH cards grant immediate access to a plurality of correlated specialty station locations near the performance station.

* * * * *